US008456411B2

(12) United States Patent
Morimoto

(10) Patent No.: US 8,456,411 B2
(45) Date of Patent: Jun. 4, 2013

(54) DISPLAY UNIT, DISPLAY DEVICE AND INFORMATION PROCESSING APPARATUS

(75) Inventor: Shinji Morimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1558 days.

(21) Appl. No.: 12/004,067

(22) Filed: Dec. 20, 2007

(65) Prior Publication Data

US 2008/0211761 A1 Sep. 4, 2008

Related U.S. Application Data

(63) Continuation of application No. PCT/JP2005/011442, filed on Jun. 22, 2005.

(51) Int. Cl.
*G09G 3/36* (2006.01)

(52) U.S. Cl.
USPC ..... 345/102; 345/87; 345/65

(58) Field of Classification Search
USPC ..... 345/102, 87, 65
See application file for complete search history.

(56) References Cited

U.S. PATENT DOCUMENTS

| | | | | |
|---|---|---|---|---|
| 7,257,430 | B2 * | 8/2007 | Lenchik et al. | 455/575.3 |
| 2003/0112217 | A1 * | 6/2003 | Lee | 345/102 |
| 2003/0234762 | A1 | 12/2003 | Nakatsuka et al. | |
| 2004/0246403 | A1 * | 12/2004 | Kim et al. | 349/65 |
| 2005/0052383 | A1 * | 3/2005 | Suzuki | 345/87 |

FOREIGN PATENT DOCUMENTS

| | | |
|---|---|---|
| JP | 4-095922 | 3/1992 |
| JP | 2000-47591 | 2/2000 |
| JP | 2000-182793 | 6/2000 |
| JP | 2004-079508 | 3/2004 |
| JP | U-3101783 | 6/2004 |
| JP | 2004-191675 | 7/2004 |
| JP | 2005-107351 | 4/2005 |

OTHER PUBLICATIONS

International Search Report of the International Published Application No. PCT/JP2005/011442 (mailed Jul. 26, 2005).
International Preliminary Report on Patentability issued in corresponding International Patent Application No. PCT/JP2005/011442, mailed on Jan. 10, 2008.

* cited by examiner

*Primary Examiner* — William Boddie
*Assistant Examiner* — Leonid Shapiro
(74) *Attorney, Agent, or Firm* — Staas & Halsey LLP

(57) ABSTRACT

A display unit having a pivot function and prolonged lives of light sources has been implemented according to the present invention. The display unit includes: a screen that is changeable between a first position and a second position and displays an image; at least one first light source that illuminates the screen in the first position; at least one second light source that illuminates the screen in the second position; and a turn-on control section that controls turning on of the first light source and the second light source according to a position. A display device and an information processing apparatus each provided with the display unit have also been implemented according to the present invention.

12 Claims, 6 Drawing Sheets

DISPLAY UNIT, DISPLAY DEVICE AND INFORMATION PROCESSING APPARATUS

CROSS REFERENCE TO RELATED APPLICATION

The present application is a continuation application based on International Application No. PCT/JP2005/011442, filed on Jun. 22, 2005, the entire contents of which are incorporated herein by reference.

TECHNICAL FIELD

The present invention relates to a display unit having a screen that displays an image and is changeable between a first position and a second position. The present invention also relates to a display device and an information processing apparatus each having such a display unit.

BACKGROUND ART

In recent years, there has been known a display unit having a so-called pivot function that allows an image-display screen of the display unit to be freely changed between a landscape position and a portrait position.

Among display units provided with such a pivot function, there is known a display unit having a so-called liquid crystal display screen. The liquid crystal display screen displays an image while receiving backlight by being driven according to image data (for example, see Patent Document 1 below).

When liquid crystals are employed to display an image, it is preferable that portions using the liquid crystals be backlighted. Among display units employing liquid crystals in a screen, there is known a display unit that obtains light for backlighting from a cold-cathode fluorescent tube that laterally extends along the top surface of the liquid crystal display screen when the screen is in a portrait position. In such a display unit, backlight is emitted, via a light-guiding plate disposed on the back surface of the liquid-crystal display screen, from the cold-cathode fluorescent tube that laterally extends along the top surface of the screen.

FIG. 1 is a diagram showing a display unit having such a liquid crystal display screen.

A display unit 100 shown in FIG. 1 includes: a liquid crystal panel 100*a* having a built-in liquid crystal display screen; and a support 100*b* for supporting the liquid crystal panel 100*a*. Part (a) of FIG. 1 shows the liquid crystal panel 100*a* in a landscape position, while Part (b) of FIG. 2 shows the same in a portrait position.

FIG. 2 is a schematic block diagram of the liquid crystal panel shown in FIG. 1.

The liquid crystal panel 100*a* shown in FIG. 2 includes a liquid crystal display screen 101*a*, a cold-cathode fluorescent tube 102*a*, and an inverter circuit 103*a* for supplying an AC voltage to drive the cold-cathode fluorescent tube 102*a*.

Part (a) of FIG. 2 shows a state in which light is obtained from the cold-cathode fluorescent tube 102*a* that laterally extends along the top surface of the liquid crystal panel 100*a* when the liquid crystal panel 100*a* is in the landscape position.

In the liquid crystal panel 100*a* shown in FIG. 2, the liquid crystal display screen 101*a* and the cold-cathode fluorescent tube 102*a* are integrated. Therefore, after the liquid crystal panel 100*a* is changed from the landscape position to the portrait position, the cold-cathode fluorescent tube 102*a* is in such a position that it vertically extends along a flank of the liquid crystal display screen 101*a* as shown in Part (b) of FIG. 2.

Patent Document 1: Japanese Patent Application Publication No. 2000-182793

By the way, when the cold-cathode fluorescent tube 102*a* of the liquid crystal panel 100*a* is used in the landscape position, as shown in Part (a) of FIG. 2, i.e., there is almost no temperature difference among parts of the fluorescent tube 102*a* and thus, it is possible to prevent occurrence of a concentration difference among parts of gas filling the inside of the tube. The concentration difference in gas is a factor that shortens the lifetime of the fluorescent tube. In contrast, when the cold-cathode fluorescent tube 102*a* is used in the portrait position as shown in Part (b) of FIG. 2, there arises such a problem that a temperature difference occurs between an upper side and a lower side of the fluorescent tube 102*a* due to heat convection inside the fluorescent tube 102*a*, which makes the distribution of the gas uneven. This uneven distribution of the gas causes a concentration difference, thereby shortening the lifetime of the tube.

The above problem is not limited to cases where a cold-cathode fluorescent tube is used as a light source. Similar problems are likely to arise when other type of light source such as a hot-cathode fluorescent tube or an LED is used, as long as the light source in use is such a type that its lifetime can be shortened by the temperature difference among parts of the light source.

DISCLOSURE OF THE INVENTION

In view of the circumstances described above, it is an object of the present invention to provide a display unit having a pivot function and a light source with a prolonged life, and also to provide a display device and an information processing apparatus each provided with such a display unit.

A display unit according to the present invention achieving the object includes:

a screen that is changeable between a first position and a second position and displays an image;

at least one first light source that illuminates the screen in the first position;

at least one second light source that illuminates the screen in the second position; and a turn-on control section that controls turning on of the first light source and the second light source according to a position.

Here, it is preferable that the screen is an oblong, and long sides of the oblong are vertical in the first position and horizontal in the second position.

It is also preferable that each of the first light source and the second light source has a tubular shape, and the turn-on control section controls the first light source and the second light source such that either one of the first light source and the second light source is turned on when a longitudinal direction of the tubular shape thereof is horizontal.

Here, it is also preferable that the display unit further includes a light-guiding plate that illuminates the screen by guiding light from each of the first light source and the second light source.

Further, it is also preferable that the light-guiding plate includes convex prisms arranged in matrix form.

A display device according to the present invention achieving the object includes:

a display unit that includes:

a screen that is changeable between a first position and a second position and displays an image;

at least one first light source that illuminates the screen in the first position;

at least one second light source that illuminates the screen in the second position; and a turn-on control section that controls turning on of the first light source and the second light source according to a position.

It is preferable here that the screen is an oblong, and long sides of the oblong are vertical in the first position and horizontal in the second position.

It is also preferable here that each of the first light source and the second light source has a tubular shape, and the turn-on control section controls the first light source and the second light source such that either one of the first light source and the second light source is turned on when a longitudinal direction of the tubular shape thereof is horizontal.

It is also preferable that the display unit further includes a light-guiding plate that illuminates the screen by guiding light from each of the first light source and the second light source.

Further, it is also preferable that the light-guiding plate includes convex prisms arranged in matrix form.

An information processing apparatus according to the present invention achieving the object includes:

a display unit that includes:

a screen that is changeable between a first position and a second position and displays an image;

at least one first light source that illuminates the screen in the first position;

at least one second light source that illuminates the screen in the second position; and a turn-on control section that controls turning on of the first light source and the second light source according to a position.

Here, it is preferable that the screen is an oblong, and long sides of the oblong are vertical in the first position and horizontal in the second position.

It is also preferable here that each of the first light source and the second light source has a tubular shape, and the turn-on control section controls the first light source and the second light source such that either one of the first light source and the second light source is turned on when a longitudinal direction of the tubular shape thereof is horizontal.

Here, it is also preferable that the display unit further includes a light-guiding plate that illuminates the screen by guiding light from each of the first light source and the second light source.

It is also preferable that the light-guiding plate comprises convex prisms arranged in matrix form.

By the way, a display unit according to the present invention achieving the above object may include:

a display screen that is changeable between a lateral position and a vertical position and displays an image by receiving backlight when driven according to image data;

a light-guiding plate that is changeable in position integrally with the display screen and is disposed on a back surface of the display screen so as to backlight the display screen by guiding light;

a first light source that is changeable in position integrally with the display screen and, when the display screen is in the lateral position, extends laterally along a top surface or a bottom surface of the display screen in the lateral position and emits light to be incident upon the light-guiding plate;

a second light source that is changeable in position integrally with the display screen and, when the display screen is in the vertical position, extends laterally along a top surface or a bottom surface of the display screen in the vertical position and emits light to be incident upon the light-guiding plate; and a turn-on control section that turns on the first light source and turns off the second light source when the display screen is in the lateral position, and that turns on the second light source and turns off the first light source when the display screen is in the vertical position.

In this display unit of the present invention, in either position, one light source that laterally extends along the top surface or the bottom surface of the display screen is turned on, while the other light source that vertically extends is turned off. Therefore, according to this display unit of the present invention, since it is possible to prevent the light source from being used in a vertically extending position, which is a factor that shortens the life of the fluorescent tube, the life of the light source for backlighting can be prolonged even if it has a pivot function.

Here, it is preferable that the first light source be disposed along the top surface of the display screen in the lateral position, and the second light source be disposed along the top surface of the display screen in the vertical position.

This makes it possible to prevent the display screen from deteriorating due to heat caused by the light sources.

It is also preferable that each of the first and second light sources be a cold-cathode fluorescent tube.

This makes it possible to reduce the size of the apparatus.

It is also preferable that the first and second light sources be independently driven by the respective inverter circuits.

This makes it possible to drive the light sources more stably.

As described above, according to the present invention, it is possible to provide a display unit having a pivot function and light sources with prolonged lives, and also to provide a display device and an information processing apparatus each having such a display unit.

BEST MODE FOR CARRYING OUT THE INVENTION

Embodiments of the present invention will be described with reference to the attached drawings.

Figure 1:
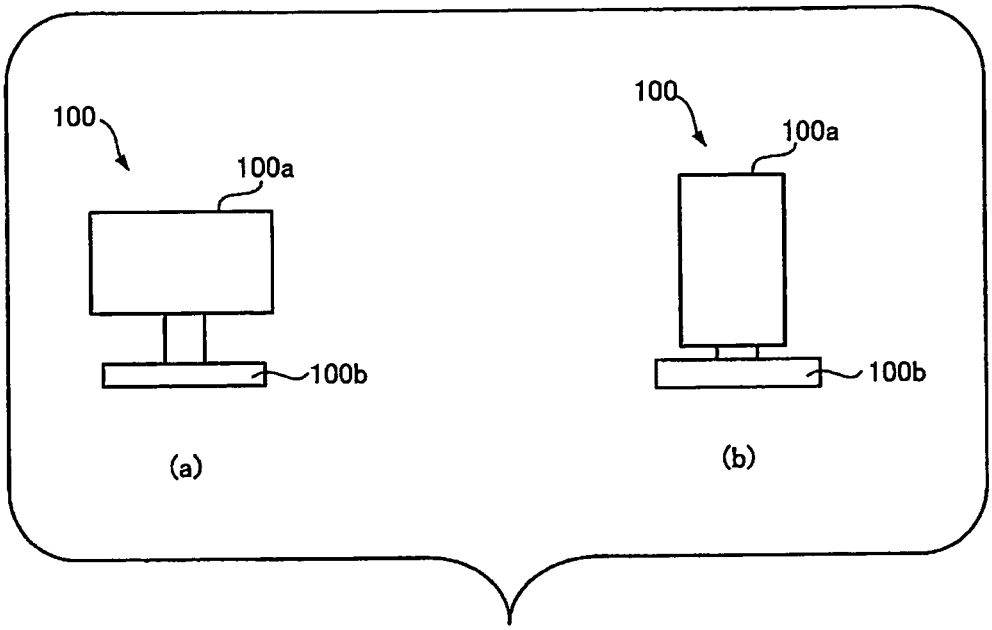
FIG. 1 is a diagram showing a display having a liquid crystal display screen.
Figure 2:
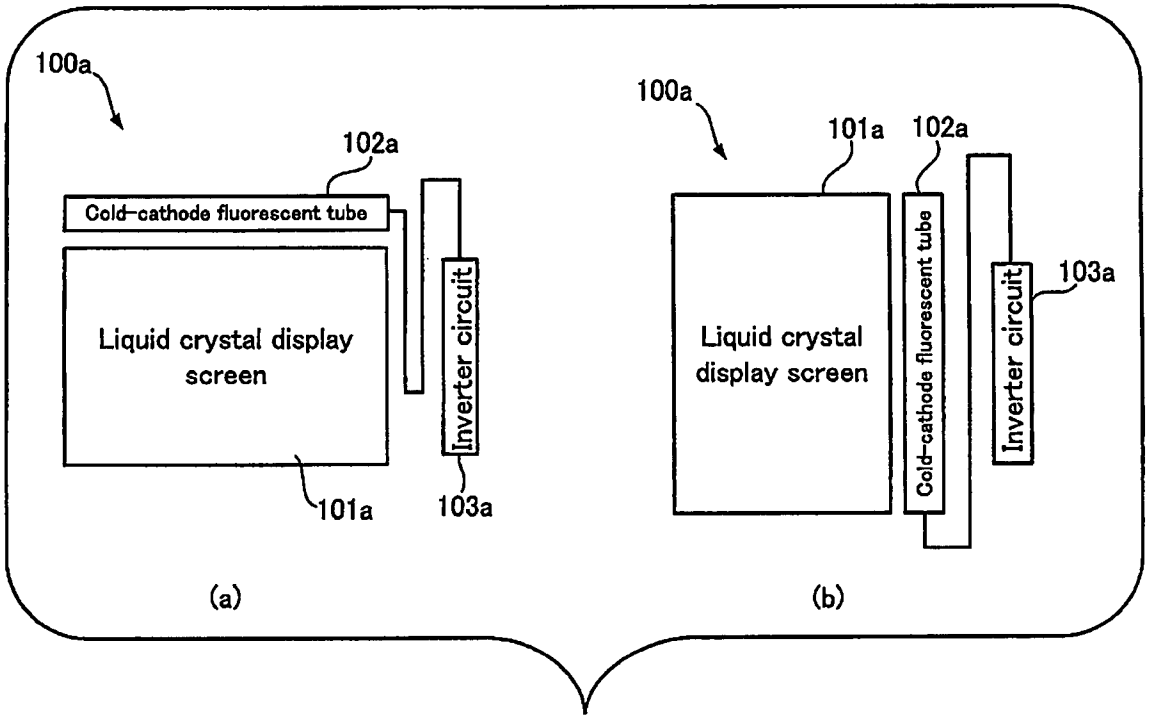
FIG. 2 is a schematic block diagram of a liquid crystal panel shown in FIG. 1.
Figure 3:
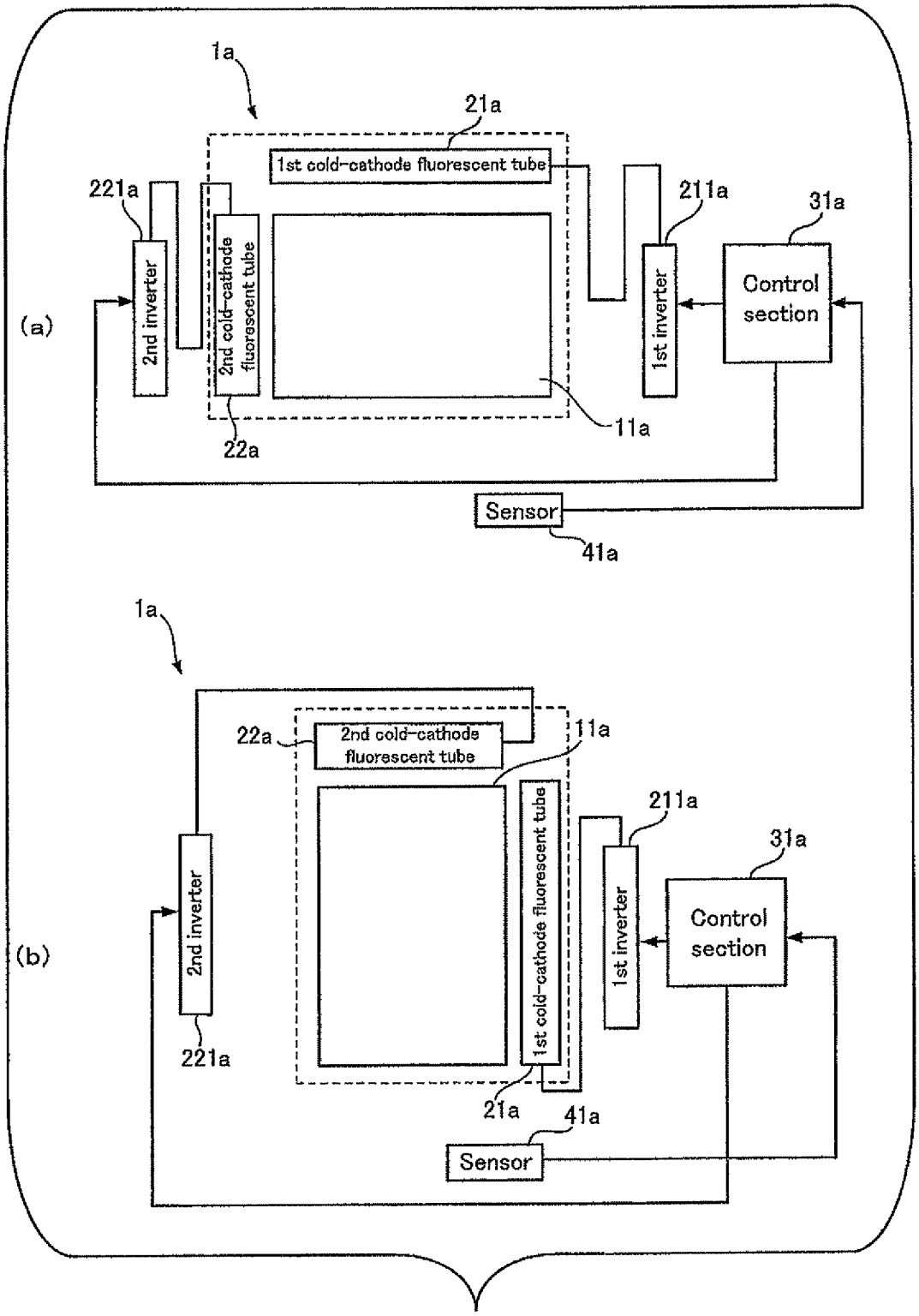
FIG. 3 is a schematic block diagram showing a first embodiment according to the present invention.

FIG. 3 is a schematic block diagram that partially illustrates a first embodiment common to the display unit, the display device, and the information processing apparatus according to the present invention.

FIG. 3 schematically shows a liquid crystal panel 1*a* that is an element of a liquid crystal display according to the present embodiment.

The liquid crystal panel 1*a* includes: a liquid crystal display screen 11*a*; a first cold-cathode fluorescent tube 21*a* disposed on a top surface of the liquid crystal display screen 11*a*; a second cold-cathode fluorescent tube 22*a* disposed on a flank of the liquid crystal display screen 11*a*; a first inverter 211*a* that drives the first cold-cathode fluorescent tube 21*a*; and a second inverter 221*a* that drives the second cold-cathode fluorescent tube 22*a*. The liquid crystal panel 1*a* further includes: a sensor 41*a* that detects whether the liquid crystal display screen 11*a* is in a landscape position or in a portrait position; a light-guiding plate 12*a* (see FIG. 5) that is disposed on a back surface of the liquid crystal display screen 11*a* and backlights the liquid crystal display screen 11*a* by guiding light from the first cold-cathode fluorescent tube 21*a* or the second cold-cathode fluorescent tube 22*a*; and a control section 31*a* that controls, according to a signal sent from the sensor 41*a*, turning on and off of the first cold-cathode fluorescent tube 21*a* and the second cold-cathode fluorescent tube 22*a*, via the first inverter 211*a* and the second inverter 221*a*. The liquid crystal display screen of the display according to the present embodiment is a TFT (Thin Film Transistor) type of screen having a pivot function. Part (a) of FIG. 3 shows the screen in the landscape position, while Part (b) of FIG. 3 shows the same in the portrait position.

The liquid crystal display screen 11*a*, the first cold-cathode fluorescent tube 21*a* and the second cold-cathode fluorescent tube 22*a* shown in FIG. 3 are integrated into one unit as shown by dotted lines in FIG. 3, and are so configured as to rotate together when changing between the landscape position and the portrait position.

In this display, when the liquid crystal panel 1*a* is in either of the landscape position and the portrait position, one cold-cathode fluorescent tube disposed on the top surface of the liquid crystal display screen 11*a* is turned on, while the other cold-cathode fluorescent tube disposed on a flank of the liquid crystal display screen 11*a* is turned off, under control of the control section 31*a*. Specifically, the first cold-cathode fluorescent tube 21*a* is turned on and the second cold-cathode fluorescent tube 22*a* is turned off in the landscape position as shown in Part (a) of FIG. 3, whereas the second cold-cathode fluorescent tube 22*a* is turned on and the first cold-cathode fluorescent tube 21*a* is turned off in the portrait position as shown in Part (b) of FIG. 3. In this way, since one that laterally extends among the two cold-cathode fluorescent tubes each serving as a backlight of the liquid crystal display screen 11*a* is turned on while the other is turned off in either position, it is possible to prevent use of the fluorescent tube in the upright position, which shortens the life of the fluorescent tube. Accordingly, the useful lives of the cold-cathode fluorescent tubes can be prolonged according to the display of the present embodiment.

Figure 4:
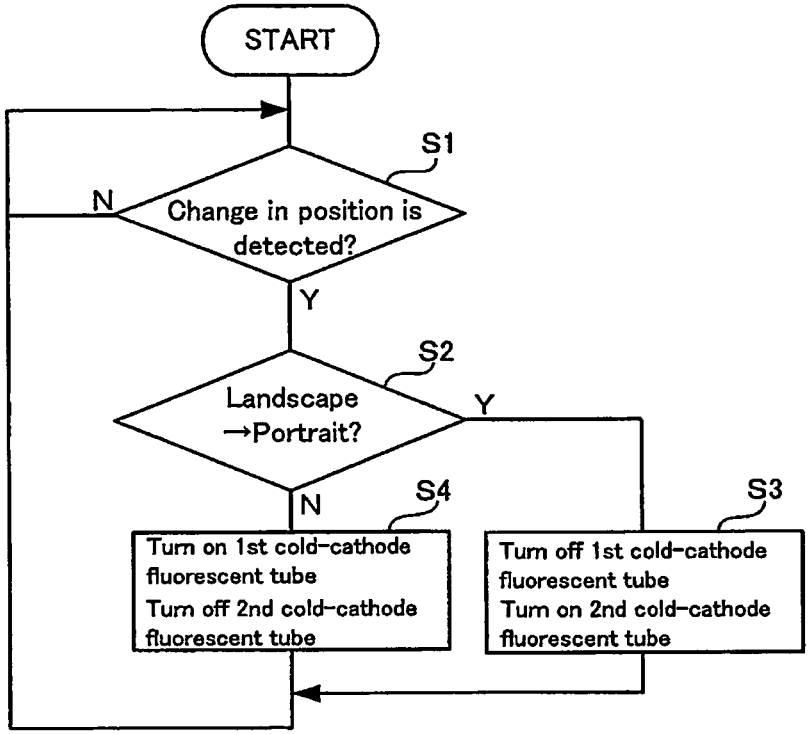
FIG. 4 is a flowchart showing a routine that is activated by a control section shown in FIG. 3 upon turning on of a power switch of a liquid crystal display.

FIG. 4 is a flowchart showing a routine that is activated by the control section shown in FIG. 3 upon turning on of a power switch of the liquid crystal display.

In step S1 shown in FIG. 4, it is determined whether a change in the position of the liquid crystal panel 1*a* is detected by the sensor 41*a*. When it is determined in step S1 that there is no change in the position, step S1 is repeated. When it is determined in step S1 that there is a change in the position, the flow proceeds to step S2. When it is determined in step S2 that the change in the position is a shift from the landscape position to the portrait position, the flow proceeds to step S3 where the first cold-cathode fluorescent tube 21*a* is turned off and the second cold-cathode fluorescent tube 22*a* is turned on. Subsequently, the flow returns to step S1.

On the other hand, when it is determined in step S2 that the change in the position is not a shift from the landscape position to the portrait position, i.e., it is a shift from the portrait position to the landscape position, the flow proceeds to step S4 where the second cold-cathode fluorescent tube 22*a* is turned off and the first cold-cathode fluorescent tube 21*a* is turned on. Subsequently, the flow returns to step S1.

Figure 5:
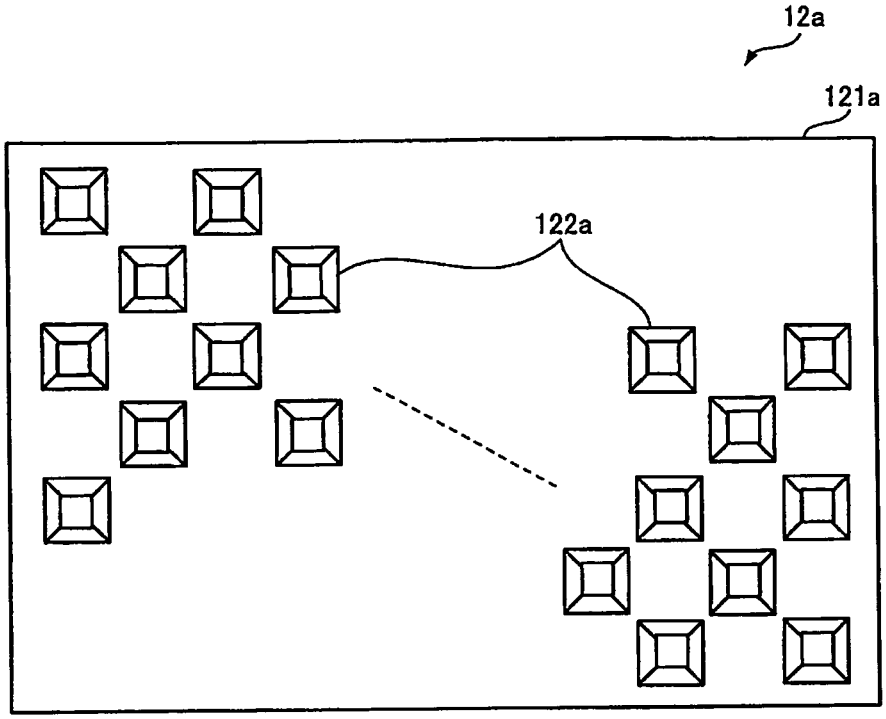
FIG. 5 is a schematic diagram showing a structure of a light-guiding plate that is an element of a liquid crystal panel.

FIG. 5 is a schematic diagram showing a structure of the light-guiding plate that is an element of the liquid crystal panel.

FIG. 5 shows the light-guiding plate 12*a* that is an element of the liquid crystal panel 1*a*, as viewed from the liquid crystal display screen 11*a* (see FIG. 3) side. The light-guiding plate 12*a* includes a base plate 121*a* and convex prisms 122*a* arranged and attached on the base plate 121*a*. In the light-guiding plate 12*a*, as shown in FIG. 5, the convex prisms 122*a* are arranged in matrix form and thus, it is possible to equally backlight the liquid crystal display screen 11*a*, whichever cold-cathode fluorescent tube is turned on as described above.

Subsequently, there will be described a second embodiment common to the display unit, the display device and the information processing apparatus according to the present invention.

Figure 6:
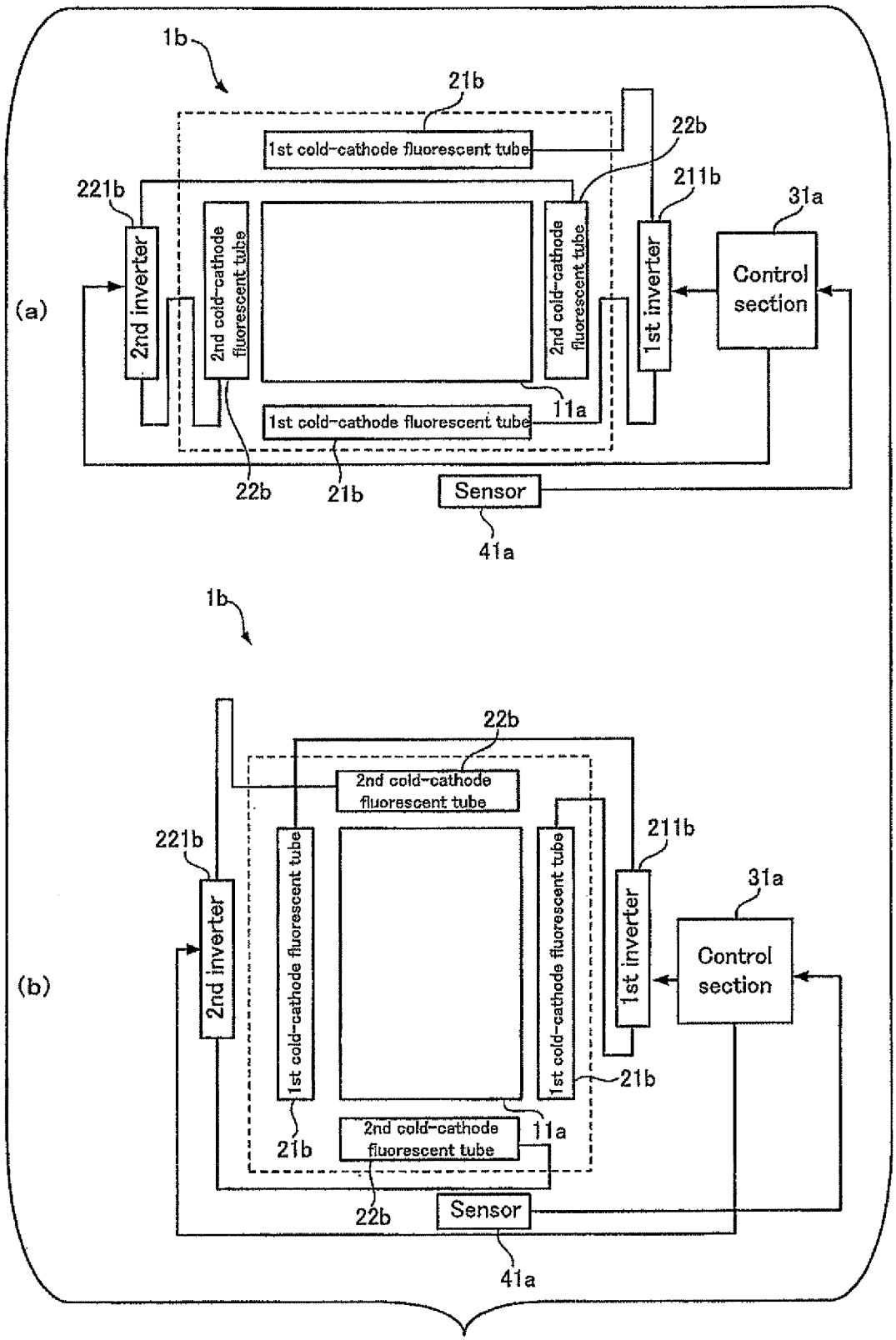
FIG. 6 is a schematic block diagram showing a liquid crystal panel of a display according to a second embodiment.

FIG. 6 is a schematic block diagram showing a liquid crystal panel of a display according to the present embodiment. The same components shown in FIG. 6 as those shown in FIG. 3 are denoted with the same reference characters as those shown in FIG. 3.

The difference between a liquid crystal panel 1*b* of the present embodiment shown in FIG. 6 and the liquid crystal panel 1*a* of the first embodiment shown in FIG. 3 is as follows. The first cold-cathode fluorescent tube 21*a* and the second cold-cathode fluorescent tube 22*a* are each provided as a single component in the first embodiment, whereas two first cold-cathode fluorescent tube 21*b* and two second cold-cathode fluorescent tube 22*b* surrounding a liquid crystal display screen 11*a* are provided in the present embodiment. In the display according to the present embodiment, the cold-cathode fluorescent tubes that laterally extend along the top surface and the bottom surface of the liquid crystal display screen 11*a* are turned on, while the cold-cathode fluorescent tubes that vertically extend are turned off. Therefore, according to the display of the present embodiment, it is possible to prolong the lives of the cold-cathode fluorescent tubes.

In the above-described embodiments, the cold-cathode fluorescent tube is used as an example of a light source, but the present invention is not limited to this type of light source. Any type of light source such as LED may be used, as long as the light source has a life that can be adversely affected by a temperature difference among parts of the light source.

In addition, there has been described an example in which the first cold-cathode fluorescent tube 21*a* and the second cold-cathode fluorescent tube 22*a* are driven by the respective inverter circuits. However, in the display unit of the present invention, a single inverter may be used to drive both of the fluorescent tubes, and a system other than the inverter type of system, such as a starter type or a rapid starter type, may be employed.

What is claimed is:

1. A display unit comprising:

a screen that is changeable between a first position and a second position and displays an image;

at least one first light source that illuminates the screen in the first position;

at least one second light source that illuminates the screen in the second position; and a turn-on control section that controls turning on of the first light source and the second light source according to a position, wherein each of the first light source and the second light source has a tubular shape, and the turn-on control section controls the first light source and the second light source such that either one of the first light source and the second light source is turned on when a longitudinal direction of the tubular shape thereof is horizontal.

2. The display unit according to claim 1, wherein the screen is an oblong, and long sides of the oblong are vertical in the first position and horizontal in the second position.

3. The display unit according to claim 1, further comprising a light-guiding plate that illuminates the screen by guiding light from each of the first light source and the second light source.

4. The display unit according to claim 3, wherein the light-guiding plate comprises convex prisms arranged in matrix form.

5. A display device comprising:

a display unit that comprises:

a screen that is changeable between a first position and a second position and displays an image;

at least one first light source that illuminates the screen in the first position;

at least one second light source that illuminates the screen in the second position; and a turn-on control section that controls turning on of the first light source and the second light source according to a position, wherein each of the first light source and the second light source has a tubular shape, and the turn-on control section controls the first light source and the second light source such that either one of the first light source and the second light source is turned on when a longitudinal direction of the tubular shape thereof is horizontal.

6. The display device according to claim 5, wherein the screen is an oblong, and long sides of the oblong are vertical in the first position and horizontal in the second position.

7. The display device according to claim 5, wherein the display unit further comprises a light-guiding plate that illuminates the screen by guiding fight from each of the first light source and the second light source.

8. The display device according to claim 7, wherein the light-guiding plate comprises convex prisms arranged in matrix form.

9. An information processing apparatus comprising:

a display unit that comprises:

a screen that is changeable between a first position and a second position and displays an image;

at least one first light source that illuminates the screen in the first position;

at least one second light source that illuminates the screen in the second position; and a turn-on control section that controls turning, on of the first light source and the second light source according to a position, wherein each of the first light source and the second light source has a tubular shape, and the turn-on control section controls the first light source and the second light source such that either one of the first light source and the second light source is turned on when a longitudinal direction of the tubular shape thereof is horizontal.

10. The information processing apparatus according to claim 9, wherein the screen is an oblong, and long sides of the oblong are vertical in the first position and horizontal in the second position.

11. The information processing apparatus according to claim 9, wherein the display unit further comprises a light-guiding plate that illuminates the screen by guiding light from each of the first light source and the second light source.

12. The information processing apparatus according to claim 11, wherein the light-guiding plate comprises convex prisms arranged in matrix form.

* * * * *